US009683427B2

(12) United States Patent
Russell

(10) Patent No.: US 9,683,427 B2
(45) Date of Patent: Jun. 20, 2017

(54) ACTIVATION DEVICES OPERABLE BASED ON OIL-WATER CONTENT IN FORMATION FLUIDS

(71) Applicant: Ronnie D. Russell, Cypress, TX (US)

(72) Inventor: Ronnie D. Russell, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 223 days.

(21) Appl. No.: 14/231,973

(22) Filed: Apr. 1, 2014

(65) Prior Publication Data

US 2015/0275623 A1 Oct. 1, 2015

(51) Int. Cl.

| | |
|---|---|
| ***E21B 34/10*** | (2006.01) |
| ***E21B 34/14*** | (2006.01) |
| ***E21B 47/06*** | (2012.01) |
| ***E21B 47/12*** | (2012.01) |
| ***E21B 21/10*** | (2006.01) |

(52) U.S. Cl.

CPC ..... *E21B 34/10* (2013.01); *E21B 21/10* (2013.01); *E21B 34/14* (2013.01); *E21B 47/06* (2013.01); *E21B 47/12* (2013.01)

(58) Field of Classification Search

CPC ..... E21B 34/10; E21B 47/12; E21B 47/06; E21B 21/10

See application file for complete search history.

(56) References Cited

U.S. PATENT DOCUMENTS

| | | | | |
|---|---|---|---|---|
| 3,938,369 | A * | 2/1976 | de Bok | G01N 11/08 137/87.04 |
| 5,509,303 | A * | 4/1996 | Georgi | E21B 47/00 73/152.18 |
| 6,584,830 | B2 * | 7/2003 | Long | G01N 11/08 73/54.06 |
| 8,322,463 | B2 * | 12/2012 | Walter | E21B 4/14 175/296 |
| 8,403,038 | B2 | 3/2013 | Russell et al. | |
| 8,403,061 | B2 | 3/2013 | Russell et al. | |
| 8,527,100 | B2 * | 9/2013 | Russell | E21B 43/12 166/228 |
| 2006/0101905 | A1 * | 5/2006 | Bittleston | E21B 49/10 73/152.24 |
| 2009/0090172 | A1 | 4/2009 | Angelescu et al. | |

(Continued)

FOREIGN PATENT DOCUMENTS

| | | |
|---|---|---|
| WO | 2011085286 A2 | 7/2011 |
| WO | 2013139601 A2 | 9/2013 |

OTHER PUBLICATIONS

Dictionary definition of "Reynolds Number", accessed on Jul. 18, 2016 via www.thefreedictionary.com.*

(Continued)

*Primary Examiner* — Blake Michener
*Assistant Examiner* — Manuel C Portocarrero
(74) *Attorney, Agent, or Firm* — Cantor Colburn LLP

(57) ABSTRACT

The disclosure provides an apparatus for use in a wellbore that includes a first device that provides a first pressure differential based on a first constituent of a fluid and a second pressure differential based on a second constituent of the fluid and a second device that utilizes the first and second pressure differentials to operate a third device that performs an operation in the wellbore.

16 Claims, 3 Drawing Sheets

(56) References Cited

U.S. PATENT DOCUMENTS

| | | | | |
|---|---|---|---|---|
| 2009/0218101 | A1* | 9/2009 | Langlais | E21B 33/122 166/313 |
| 2009/0301730 | A1* | 12/2009 | Gweily | E21B 23/00 166/369 |
| 2011/0079387 | A1* | 4/2011 | Russell | E21B 43/12 166/250.15 |
| 2012/0090831 | A1* | 4/2012 | Weirich | E21B 34/14 166/205 |

OTHER PUBLICATIONS

PCT International Search Report and Written Opinion; International Application No. PCT/US2015/017512; International Filing Date: Feb. 25, 2015; Date of Mailing: Jun. 1, 2015; pp. 1-14.

* cited by examiner

ACTIVATION DEVICES OPERABLE BASED ON OIL-WATER CONTENT IN FORMATION FLUIDS

BACKGROUND

1. Field of the Disclosure

This disclosure relates generally to devices for use in a wellbore, specifically devices that may be utilized to control another device, wherein the output of such devices is based on content in the formation fluid flowing into the wellbore.

2. Background of the Art

Wellbores are drilled in subsurface formations for the production of hydrocarbons (oil and gas). Modern wells can extend to great well depths, often more than 15,000 ft. Hydrocarbons are trapped in various traps or zones in the subsurface formations at different depths. Such zones are referred to as reservoirs or hydrocarbon-bearing formations or production zones. To produce hydrocarbons from such zones, a completion system that typically includes a casing and a production string therein is deployed in the wellbore. The casing is perforated at spaced apart locations to allow fluid from the various production zones to enter into the casing. The production string includes a sand screen adjacent each perforated section to inhibit the flow of rock particles from the formation into the production string. Flow control devices, such as sliding sleeve valves and other devices are employed to control the flow of the fluid from the production zones into the production string. Some such devices are electrically-controlled and others are controlled by mechanical tools conveyed from the surface.

The disclosure herein provides a device that operates based on the oil and water contents in the formation fluid flowing into the wellbore, which device may be used, among other things, as a switch or as a device to operate another device, such as a sliding sleeve valve.

SUMMARY

The disclosure provides an apparatus for use in a wellbore that in one non-limiting embodiment includes a first device that provides a first pressure differential or pressure drop based on a first constituent of a fluid and a second pressure differential or a pressure drop based on a second constituent of the fluid and a second device that utilizes the first and second pressure differentials to operate a third device that performs an operation in the wellbore.

In another aspect, a method of performing an operation in a wellbore is disclosed that in one non-limiting embodiment includes: conveying a string in the wellbore that includes a first device configured to perform an operation in the wellbore and a second device that provides a plurality of pressures when a formation fluid flows through the second device; flowing the formation fluid through the second device; and operating the first device using the plurality of pressures.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
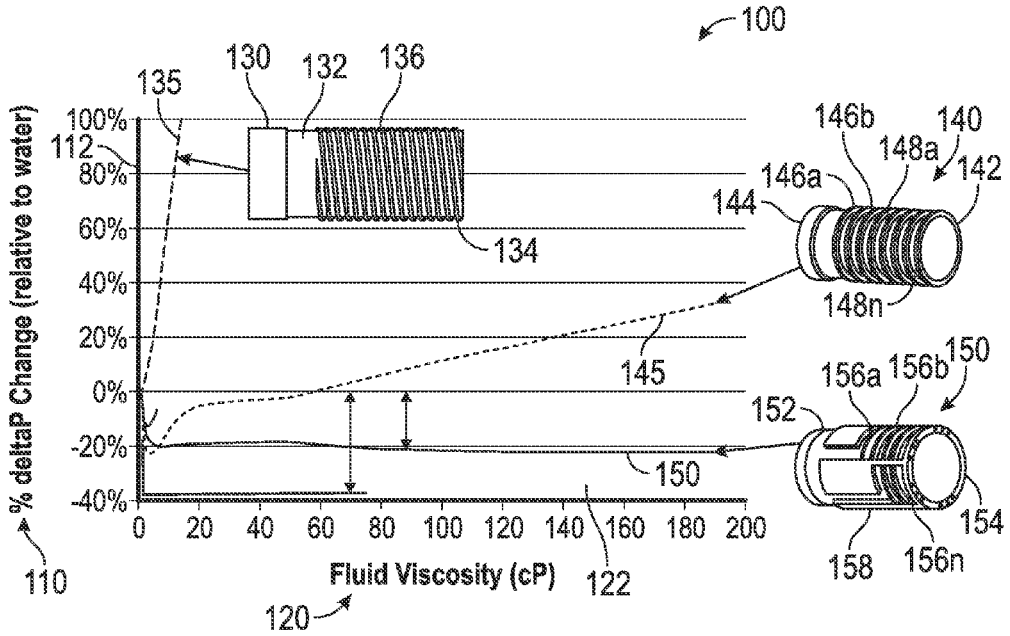
FIG. 1 is a graph showing pressure drop change relative to water across different types of inflow control devices.

FIG. 1 is graph 100 showing pressure drop change relative to water across three different exemplary inflow control device (ICD) types known in the art. The percent change in pressure drop (Δp) 110 relative to water is shown along the vertical axis (or y-axis) 112 and the viscosity of the fluid (Cp) 120 flowing through each device is shown along the horizontal axis (or x-axis) 120. Curve 135 shows the pressure drop change for the first ICD 130, curve 145 shows pressure drop for the second ICD 140 and curve 155 shows pressure drop for the third ICD. ICD 130 is a helical type device, wherein the fluid enters at inlet area 132 and flows through a helical path 136 and exits at outlet 134. ICD 140 includes a series of spaces or areas 146*a*, 146*b* . . . 146*n* with cuts or holes 148*a*-148*n* at 180 degrees from one cut to another for the fluid to flow from one area to the next. In ICD 140, fluid enters at inlet 144 and travels through the areas 146*a*, 146*b*, etc. via holes 148*a*-148*n* between such areas and exits at outlet end 142. ICD 150 includes partial rings 156*a*, 156*b*, 156*n* etc. with cuts 158 for the fluid to pass from one area to the next. Rings 156*a*, 156*b*, 156*c*, etc. may be quarter rings, third rings, half rings or include any other configuration to provide a tortuous path to the fluid flowing through the device 150. In ICD 150, fluid enters at inlet area 152 and travels through areas 146*a*, 146*b*, 146*n*, etc. via cuts 148 and exits at outlet 154. Each ICD provides a tortuous path for the fluid to flow, which produces a pressure drop across the device based on one or more physical properties of the fluid, such as viscosity and density. As seen from substantially vertical curve 135 corresponding to ICD 130, the change in pressure drop 120 is quite rapid with the change in viscosity 120 of the fluid, indicating that ICD 130 is very sensitive to viscosity. Therefore water flow provides very low pressure drop across ICD 130 while oil flow provides relatively high pressure drop across the device. Curve 155 corresponding to ICD 150, however, shows a substantially flat curve 155 with the change in viscosity of the fluid over a large range, indicating that device 150 will provide low pressure change when oil is flowing through the device and high pressure drop when water is flowing through the device. Curve 145 shows sensitivity to both water and oil.

In one aspect, the disclosure provides an apparatus or device that utilizes provides pressure drops based on oil and water contents (i.e., constituents of a mixture of fluids). In one aspect, the disclosure provides using passive flow devices to generate the pressure drops. In another aspect, the disclosure provides utilizing at least two inflow control devices, one that produces a relatively large pressure drop due to a first fluid, such as water, and the other device that produces a relatively large pressure drop due to a second fluid, such as oil, as described in more detail in reference to FIGS. 2-4.

Figure 2:
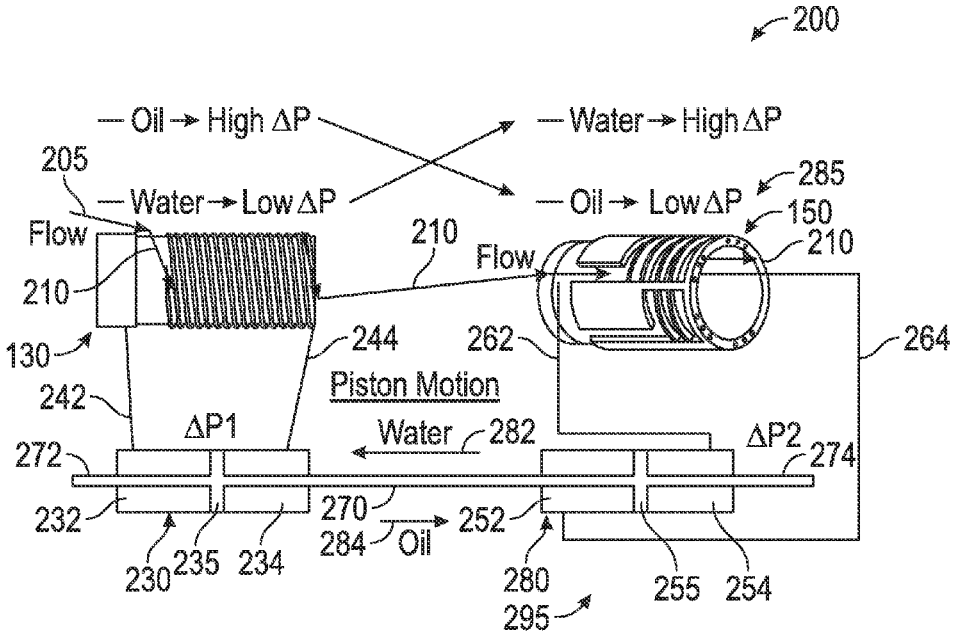
FIG. 2 illustrates a pressure drop device that provides pressure drops or pressure differentials across two inflow control devices and use of such pressure drops to a pair of pistons to provide a force, such as linear motion, to a member that may be used to perform an operation in the wellbore.

FIG. 2 shows an exemplary device 200 for generating a force triggered by pressure drops generated based on constituents of fluids flowing through the device. The device 200 includes a pressure drop device 285 that provides pressure differentials or pressure drops due to flow of certain fluids therethrough and a force generating device 295 (also referred to herein as a "work device") that utilizes the pressure differential provided by the device 285 to generate a force, which force may be utilized to perform a function or operation, including, but, not limited to, operating a device downhole. In another aspect, the pressure drops generated may be utilized as switch to activate and deactivate a device or as a sensor to provide information, such type of fluid constituents and their relative amounts in the fluid. In the particular embodiment of FIG. 2, the device 285 includes a device 130 that produces a pressure drop $\Delta_{p1}$ in series with another device 150 that produces a pressure drop $\Delta_{p2}$, when fluid 205 flows from the wellbore into the first device 130 and then to the second device 150 as shown by arrows 210. The pressure drop $\Delta_{p1}$ is relatively high when oil flows through the device 130 and relatively low when water flows through the device 130 while pressure drop $\Delta_{p2}$ is relatively high when water flows through the device 150 and relatively low when oil flows through the device 150. In the particular configuration of device 285, the pressure drop $\Delta_{p1}$ across device 130 is coupled to sides 232 and 234 of a fluid chamber 230 separated by a floating piston 235 via fluid lines 242 and 244 respectively. Similarly, pressure drop $\Delta_{p2}$ across device 150 is coupled to sides 252 and 254 of a fluid chamber 250 separated by a floating piston 255 via fluid lines 262 and 264 respectively. In this manner, movement of one piston moves the other piston based on the difference between pressure drops $\Delta_{p1}$ and $\Delta_{p2}$. The pistons 235 and 255 are connected by a member 270. A member or rod 272 extending from piston 235 and through chamber 230 provides linear motion on one side of the device 295 (in this case on the left side) and a member or rod 274 extending from piston 255 and through chamber 250 provides linear motion on the other side of the device 295 (in this case on the right side).

Still referring to FIG. 2, when the water amount in the fluid 205 increases, $\Delta_{p1}$ decreases and $\Delta_{p2}$ increases, causing the pistons 255 and thus piston 235 to move to the left as shown by arrow 282. When the oil amount increases, $\Delta_{p2}$ decreases and $\Delta_{p1}$ increases, causing the pistons 235 and thus piston 255 to move to the right, as shown by arrow 284. Thus, depending or based on the oil and water contents (fluid constituents), members 272 and 274 move to the left and right, thereby providing linear motion of members 272 and 274 based on the oil/water content of the formation fluid 205. Although various pressures or pressure drops are shown generating force that is translated into a linear motion, such pressures or pressure drops may be utilized to the generate force for use in any other manner or for any other purpose.

Figure 3:
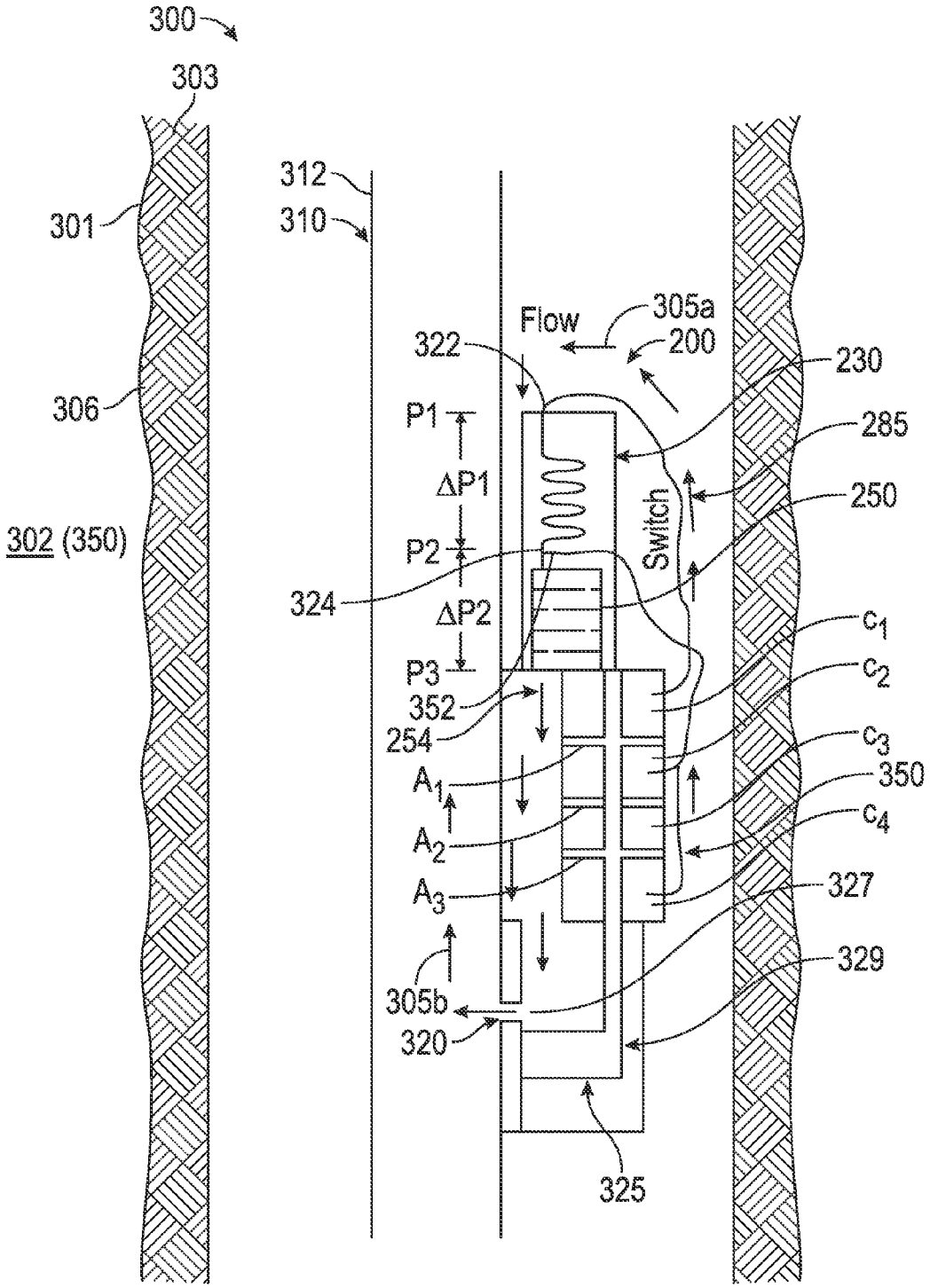
FIG. 3 shows the liner motion device of FIG. 2 controlling a sliding sleeve valve in a wellbore.

FIG. 3 shows a wellbore system 300 that includes a production string or assembly 310 utilizing a device, such as a device 285, to provide pressure drops and a force generating device 350, made according to one non-limiting embodiment of the disclosure, to control an operation of a downhole device, such as a sliding sleeve valve 320. The wellbore system 300 includes a wellbore 301 formed in a formation 302. A casing 304 is placed in the wellbore 301 and the annulus 303 between the casing 304 and the wellbore 301 is filled with cement 306. The assembly 310 is deployed inside the casing 304 and includes a production tubing 312 that may include a number of devices to control flow of the formation fluid 305 into the casing 304 and other devices to perform a number of other functions or operations in the wellbore. For simplicity and for ease of explanation and not as a limitation, the assembly 310 is shown to include a single flow device 320 (in this case a sliding sleeve valve 320) that may be controlled by the device 200 for controlling the flow of fluid the 305 from the casing 304 into the tubing 312. In one aspect, the device 350 may be utilized to selectively open and close the sliding sleeve valve 320. As shown, the device 285 includes pressure drop devices 230 and 250 in series and a force generating device 350. The first pressure drop device 230 receives the fluid 305 from inside the casing 304 at inlet 322 at a pressure P1, as shown by arrows 305*a*, and discharges such received fluid via an outlet 324 at pressure P2, wherein P1 is greater than P2. The device 250 receives the fluid at pressure at inlet 252 and discharges the fluid at P3 into the sliding sleeve valve 320 at outlet 254, wherein P2 is greater than P3, which fluid then flows into the tubing 312 as shown by arrows 305*b*, wherein P2 is greater than P3. The device 230 provides a pressure differential or pressure drop $\Delta_{p1}$ (P1–P2) and device 250 provides a pressure differential or pressure drop $\Delta_{p2}$ (P2–P3). In the particular configuration of device 200, the device 230 is sensitive to viscosity and therefore the pressure differential $\Delta_{p1}$ will be low when water content is high; and device 250 is sensitive to density and therefore the differential pressure $\Delta_{p2}$ will be high when oil amount is high, as discussed in reference to FIG. 2. The device 350, which is substantially similar to device 295 shown in FIG. 2, includes chambers C1, C2, C3 and C4 with interconnected pistons A1, A2 and A3 between the chambers. The piston A3 is connected to a sliding sleeve 329 that slides across the opening 327 of the sliding sleeve valve 320. In the particular configuration of device 350, pressure P1 is applied to chamber C1, P2 to chamber C2, P3 to chamber C3 and P2 to chamber C4. Therefore, as the water content in the fluid 305 increases, $\Delta_{p1}$ will be less than $\Delta_{p2}$, causing the member 329 to move upward which will move the sliding sleeve 325 toward the opening 327. As the difference increases between $\Delta_{p2}$ and $\Delta_{p1}$ the member 329 will move upward to partially or fully close the valve opening 327 depending upon the amount of water and oil in fluid 305. Thus, in general, the device 285 provides a pair of opposing pressure drops based on at least two constituents of a fluid that may be utilized to perform a mechanical function or operation. In one aspect, the pressure drops may be utilized to provide linear motion to a member that may be utilized to operate a device or to perform another desired function.

Figure 4:
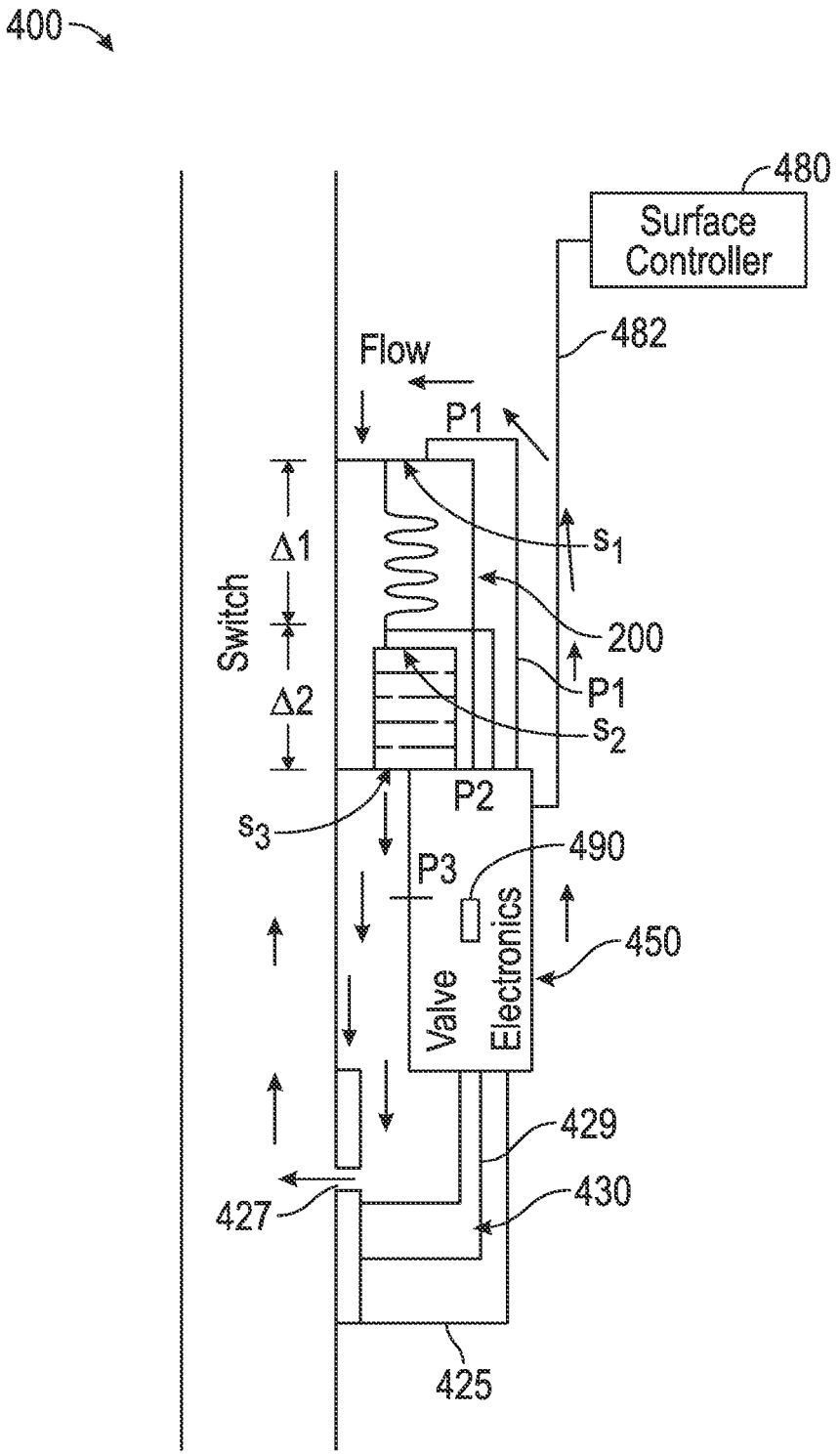
FIG. 4 shows the output of the linearly coupled pressure drop device of FIG. 2 being utilized as a sensor for remotely controlling a sliding sleeve valve from a surface location.

In another aspect, the pressure drop device, such as device 285 (FIG. 2) may be utilized as a switch or a sensor. As an illustration and not as a limitation relating to the use of the pressure drop device 285, FIG. 4 shows a wellbore system 400 that includes a production string 410 that utilizes the pressure drop device 285 (FIG. 2) as a switch or sensor to perform an operation or a function downhole, such as to control a valve in the wellbore system 400. As discussed earlier in reference to FIG. 2, the device 285 provides pressures P1, P2 and P3. In one aspect, sensors S1, S2 and S3 may be utilized to provide signals corresponding to pressures P1, P2 and P3 respectively to a circuit 450 that determines therefrom the pressure values P1, P2 and P3. In one aspect, the circuit 450 may send the pressure values or signals to a surface controller 480 via any telemetry method 482 known in the art, including, but not limited to, mud pulse telemetry, electromagnetic telemetry, hard wire and optical fibers. The controller 480 may send command signals to the circuit 450, which circuit may operate a device, such as valve member 429 to move the sliding sleeve 425 a selected distance in response to the command signals from the controller 480 to control the flow of the fluid 305 through the opening 427 of the valve 430. Alternatively, the circuit 450 may include a controller 490 that is programmed to move the member 429 to control the flow through the valve 430. Alternatively, the controller 480 and 490 may be programmed to perform such functions partially. Thus, in one aspect, the device 285 may be utilized to provide pressures or pressure differentials based on constituents of a fluid, which pressures or pressure differentials may be used to perform a function or an operation, including, but not limited to, operating a switch, providing force to operate or control a device. In particular, the device may provide pressure differentials based on oil and water in a formation fluid entering into a wellbore.

In aspects, the pressure drop device 285 (FIG. 2) may utilize any two or more suitable passive fluid flow devices, wherein one generated pressure drop depends on one property of the formation fluid, such as viscosity (in this case water) and the other generated pressure drop depends on another property of the formation fluid, such as density (in this case oil). The pressure differentials or different pressures may be utilized to provide a selected movement of a work device, such as the piston-chamber device 250 shown in FIG. 2 or any other device that utilizes the pressures to provide a force, such as force via a movable member. The force generated by the pressure differentials or the pressures at the output of such devices, such as pressures P1, P2 and P3 shown in FIG. 2, may be utilized to perform any suitable function or operation downhole. Selecting different fluid flow devices allows to select the pressure differentials generated by the device for a particular operation, including, but not limited to, operating a valve, moving a member and any other suitable operation.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a pressure drop device including:

a first inflow control device that selectively provides a first pressure differential based on a first constituent of a fluid; and a second inflow control device that selectively provides a second pressure differential based on a second constituent of the fluid, wherein the second inflow control device is in fluid communication with the first inflow control device; and a controller that determines at least one of the first pressure differential and the second pressure differential at the first inflow control flow device and the second inflow control flow device.

2. The apparatus of claim 1, wherein the first constituent is water and the second constituent is oil.

3. The apparatus of claim 1, wherein:

the first inflow control device receives the fluid at an inlet and discharges the received fluid at a first outlet; and the second inflow control flow device receives the fluid discharged by the first inflow control flow device and discharges the fluid received from the first inflow control flow device to a second outlet.

4. The apparatus of claim 1, wherein one of the first pressure differential and the second pressure differential is sensitive to viscosity of the fluid and the other of the first pressure differential and the second pressure differential is sensitive to density of the fluid.

5. The apparatus of claim 1 further comprising:

a work device responsive to the pressure differential or pressures from the pressure drop device generates a force.

6. The apparatus of claim 5, wherein the work device is coupled to the pressure drop device to provide a motion to a member in response to the first differential pressure and the second differential pressure.

7. The apparatus of claim 6, wherein the work device is a hydraulic device that is operated by a first pressure of the first pressure differential at an input to a first inflow control flow device, a second pressure of the first pressure differential at an output of the first inflow control flow device and a third pressure of the second pressure differential at an output of the second inflow control flow device.

8. The apparatus of claim 1, wherein the controller operates a device in response to at least one of the first pressure differential and the second pressure differential in the wellbore.

9. The apparatus of claim 8, wherein the controller is placed at a location selected from a group consisting of: in the wellbore; at a surface location; and partially in the wellbore and partially at a surface location.

10. A string for use in a wellbore, comprising:

a string including a first device configured to perform an operation in the wellbore and a second device configured to operate the first device, the second device comprising:

a pressure generating device including:

a first inflow control device that selectively provides a first pressure differential based on a first constituent of a fluid; and a second inflow control device that selectively provides a second pressure differential based on a second constituent of the fluid, wherein the second inflow control device is in fluid communication with the first inflow control device;

a work device that controls the operation of the first device in response to the at least one of the first pressure differential and the second pressure differential provided by the pressure generating device; and a controller that determines at least one of the first pressure differential and the second pressure differential at the first inflow control flow device and the second inflow control flow device.

11. The string of claim 10, wherein the pressure generating device provides at least three pressures and wherein the work device utilizes the at least three pressures to generate a force to operate the first device.

12. The string of claim 10, wherein:

the first inflow control flow device that receives the fluid at a first pressure and discharges the received fluid at a second pressure; and the second inflow control flow device that receives the fluid at the second pressure and discharged the received fluid at a third pressure, wherein the first pressure is greater than the second pressure and the second pressure is greater than the third pressure.

13. The string of claim 12, wherein the at first inflow control flow device output is sensitive to viscosity of the fluid and second inflow control flow device output is sensitive to density of the fluid.

14. A method of performing an operation in a wellbore, comprising:

conveying a string in the wellbore that includes a first device configured to perform an operation in the wellbore and a second device that provides a plurality of pressures when formation fluid flows through the second device;

flowing the formation fluid through the second device, wherein the second device includes:

a first inflow control device that selectively provides a first pressure differential based on a first constituent of a fluid; and a second inflow control device that selectively provides a second pressure differential based on a second constituent of the fluid, wherein the second inflow control device is in fluid communication with the first inflow control device; and controlling the first device using the plurality of pressures, wherein a controller determines at least one of the first pressure differential and the second pressure differential at the first inflow control flow device and the second inflow control flow device.

15. The method of claim 14, wherein a first property is viscosity and a second property is density.

16. The method of claim 14, wherein:

the first inflow control flow device that receives the formation fluid at a first pressure and discharges the received fluid at a second pressure; and the second inflow control flow device that receives the fluid at the second pressure and discharges the received at a third pressure; and wherein the first pressure is greater than the second pressure and the second pressure is greater than the third pressure.

* * * * *